US008011664B2

(12) United States Patent
Hilbert, Jr. et al.

(10) Patent No.: US 8,011,664 B2
(45) Date of Patent: Sep. 6, 2011

(54) RING TOSS SKILL GAME

(75) Inventors: Cleighton L. Hilbert, Jr., Richmond, VA (US); Joseph Hewes Parrish, III, Raleigh, NC (US)

(73) Assignee: 5 Mississippi LLC, Richmond, VA (US)

( * ) Notice: Subject to any disclaimer, the term of this patent is extended or adjusted under 35 U.S.C. 154(b) by 76 days.

(21) Appl. No.: 12/358,286

(22) Filed: Jan. 23, 2009

(65) Prior Publication Data

US 2010/0187760 A1 Jul. 29, 2010

(51) Int. Cl.
*A63B 67/10* (2006.01)

(52) U.S. Cl. ..... 273/332; 273/336; 273/331

(58) Field of Classification Search ..... 273/317, 273/331, 332, 335, 336, 343
See application file for complete search history.

(56) References Cited

U.S. PATENT DOCUMENTS

| | | | | |
|---|---|---|---|---|
| 292,899 | A | 2/1884 | Davies | |
| 898,469 | A * | 9/1908 | Harriss | 273/332 |
| 1,121,353 | A | 12/1914 | Grikscheit | |
| 2,095,390 | A | 10/1937 | Lange et al. | |
| 2,147,176 | A | 2/1939 | Ronzone | |
| 2,942,886 | A | 6/1960 | Ackerman | |
| 2,950,917 | A | 8/1960 | Lyon | |
| 2,950,918 | A | 8/1960 | Lyon | |
| 2,991,034 | A | 7/1961 | Lyon | |
| 3,009,702 | A * | 11/1961 | Lyon | 273/332 |
| 3,520,535 | A | 7/1970 | Dubbs et al. | |
| 3,901,505 | A * | 8/1975 | Gerechter | 446/27 |
| 3,930,649 | A * | 1/1976 | Yackel, Jr. | 273/331 |
| 4,120,498 | A | 10/1978 | Mutschler et al. | |
| 4,564,200 | A | 1/1986 | Loring et al. | |
| D285,811 | S | 9/1986 | Donahoe | |
| 4,739,995 | A * | 4/1988 | Yackel, Jr. | 273/331 |
| 5,171,019 | A | 12/1992 | Arnette | |
| 5,709,604 | A | 1/1998 | Coats et al. | |
| 5,954,597 | A | 9/1999 | Smith | |
| D423,057 | S | 4/2000 | Mooney | |
| 2009/0206550 | A1 * | 8/2009 | Pershin et al. | 273/332 |

* cited by examiner

*Primary Examiner* — Raleigh W. Chiu
(74) *Attorney, Agent, or Firm* — Goodman, Allen & Filetti PLLC

(57) ABSTRACT

A multi-player ring toss game is described. The game includes multiple arms extending from a support stand. Players toss rings or similar objects that are tethered to the arms and attempt to hook them on hooks. In specific implementations, the ring toss game is foldable and portable using a folding mechanism to convert the apparatus from a playing position to a storing position.

23 Claims, 5 Drawing Sheets

RING TOSS SKILL GAME

FIELD OF THE INVENTION

The present invention relates generally to skill games and more particularly to a ring toss skill game.

BACKGROUND OF THE INVENTION

Previous ring toss skill games using tethered rings have generally had the tethered ring and hook mounted to the ceiling and wall. For example, U.S. Pat. No. 5,171,019 describes a tethered ring and hook game kit where the tethered ring is mounted to the ceiling and the hook is mounted to a wall, and U.S. Pat. No. 3,009,702 describes a wall mounted ring and hook game where both the hook and the arm supporting the tethered ring are mounted to a wall.

To avoid the necessity of mounting to a ceiling or wall, previous ring toss skill games have also used stands to support the apparatus. For example, U.S. Pat. No. 2,950,917 describes a tethered ring and hook game assembly having legs that may be used to support the game for use indoors or outdoors, such as in the corner of a room or on a playing court. U.S. Pat. No. 4,120,498 describes a tethered ring amusement system that includes a base member that can rest on a base surface.

It would be advantageous to have improved apparatus and techniques relating to ring toss skill games. It is desirable to have ring toss skill games that can be used by multiple players, without the need to use the same rings and hooks. For example, it would be advantageous to have a game having multiple rings, hooks, and arms. Previous ring toss skill games are often bulky and not easily collapsible or storable. It would be advantageous to have a ring toss skill game that could be easily foldable and storable.

SUMMARY OF THE INVENTION

The invention provides various exemplary embodiments, including devices, apparatus, and methods. In general, the embodiments are implemented in relation to ring toss skill games.

These and other features and advantages of exemplary embodiments of the invention are described below with reference to the accompanying drawings.

DETAILED DESCRIPTION

Figure 1:
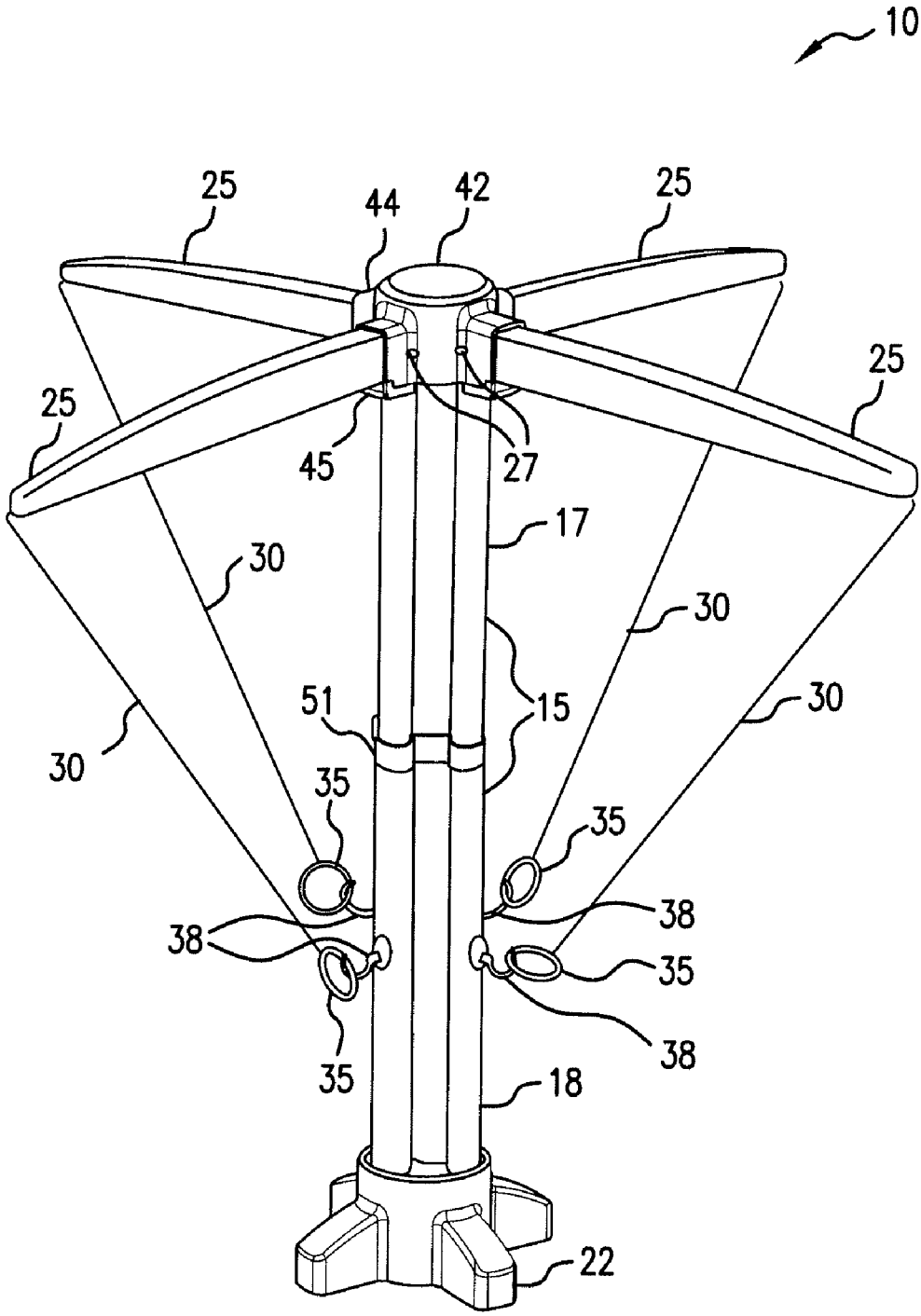
FIG. 1 is a perspective view of a ring toss game apparatus in the playing position.

In the following detailed description, numeric values and ranges are provided for various aspects of the implementations described. These values and ranges are to be treated as examples only and are not intended to limit the scope of the claims. In addition, a number of materials are identified as suitable for various facets of the implementations. These materials are to be treated as exemplary and are not intended to limit the scope of the claims.

The general term "ring toss game" is used herein to refer to any type of device, system, or other article or apparatus where one or more players may attempt to toss a tethered ring around a hook. A ring toss game may be implemented in several ways: For example, in some techniques, the apparatus may be placed on a table top and the players are seated around the table taking turns in tossing the rings toward the hooks. In such an implementation, the apparatus would generally be less than about 4 feet in height. In other implementations, the apparatus may be set upon the floor or ground and the players would toss the rings from a standing position, which could be 4 to 6 feet in height or more. Such a version would be larger than a table top version, for example, about four to six feet in height. In the larger version, all of the parts would be correspondingly scaled up in size.

The term "ring toss game apparatus" is used herein to mean the overall device or apparatus used by the players in playing the game. Existing ring toss games, such as those described above, do not include multiple arms to facilitate multi-player use. Existing ring toss games are not easily collapsible and portable for ease of use in multiple locations and situations.

The ring toss game apparatus is made of various components described below, such as a support stand, arms, cords, ring-like members, hooks, and optionally folding mechanisms.

The overall apparatus is supported by a "support stand" that typically holds the apparatus in the vertical position with respect to the table top or other surface when the apparatus is in the playing position. The "arms" refer to the members that, when the apparatus is in the playing position, run approximately parallel with the table top or other surface. A "ring-like member" is a part that, like a ring, approximates a circular torus for at least part of its length; a "ring-like member" may also be used to refer to other shapes that can fit around the hook, for example, a square, rectangle, triangle, or other shape.

As used herein, the term "playing position" refers to the state of the apparatus where it is in a position that is ready and available for play by the players. For example, the support stand is extended and the arms are extended out from the support stand. The term "storing position" refers to the state of the apparatus where it is ready for transport or storage. For example, the support stand may be telescoped together and the arms may be folded to be parallel with the support stand.

As used herein, the term "folding mechanism" refers to a single mechanical part or a combination of mechanical parts that, when operated together, assist in moving the apparatus from the playing position to the storing position, or vice versa.

In the implementations described below, apparatus, systems, or parts or components of apparatus or systems are referred to as "attached" to each other or to other apparatus, systems, parts, or components or vice versa, and operations are performed that "attach" apparatus, systems, or parts or components of apparatus or systems to each other or to other things or vice versa; the terms "attached", "attach", and related terms refer to any type of connecting that could be performed in the context. One type of attaching is "mounting", which occurs when a first part or component is attached to a second part or component that functions as a support for the first. In contrast, the more generic term "connecting" includes not only "attaching" and "mounting", but also making other types of connections such as between or among parts formed as a single piece of material by molding or other fabrication, in which case connected parts are sometimes referred to as "integrally formed". Connecting does not, however, include a mere transitory contact or engagement. A combination of one or more parts connected in any way is sometimes referred to herein as a "structure". Some structures or other parts are also described by structural features.

FIGS. 1-4 show ring toss game apparatus 10 which could be implemented in a wide variety of different ways. In the implementation shown in FIGS. 1-4, ring toss game apparatus 10 includes support stand 15. Support stand 15 can be implemented as a single piece or as multiple pieces. FIGS. 1-4 show support stand 15 implemented as two pieces, an upper piece 17 and a lower piece 18. Upper piece 17 has an inner diameter that is slightly smaller than the inner diameter of lower piece 18 so that upper piece 17 may slide within or telescope within lower piece 18. Bushings 51 permit upper piece 17 of support stand 15 to slide or telescope within lower piece 18. When ring toss apparatus 10 is in the playing position as in FIG. 1, upper piece 17 is not inside lower piece 18, whereas when ring toss apparatus 10 is in the storing position as in FIG. 3, upper piece 17 is inside lower piece 18. A button or pin (not shown) may be used to hold upper piece 17 and lower piece 18 in the desired position.

Support stand 15 may be formed of plastic, metal, or similar material, and may be tubular or tube-like in shape, but may also have a square, rectangular, or other regularly or irregularly shaped cross-section as understood by those of ordinary skill in the art. Support stand 15 may be extendable in some implementations described herein, but is not necessarily required to be so. Extendable implementations may include foldable pieces, telescoping pieces, or pieces cut from the same mold to make a seamless piece. Support stand 15 may also include detachable pieces. Support stand 15 is shown in FIGS. 1-4 having a shape wherein the arms 25 (described below) fit within indentations in support stand 15 when in the storing position, as shown in FIG. 3.

Support stand 15 is shown in FIGS. 1-4 to be supported by an optional base 22 that can be used to support ring toss game apparatus 10 on a table or other surface. A larger version of ring toss game apparatus 10 may even be supported by optional base 22 on the floor or ground for indoor or outdoor use. Such a larger version may be about four to six feet or more in height. While optional base 22 shown in FIGS. 1-4 would be used to support ring toss game apparatus 10 on a flat surface, a floatable or buoyant base could also be used for a floatable, water-based or pool-based implementation of ring toss game apparatus 10. In an additional implementation, the arms, body, and base may be made from rubber or plastic and inflated with air. In other implementations, base 22 may include a tripod, may be collapsible by hinges, may be cantilevered, or snap-locked. Base 22 may be extendable by folding or telescoping, may be detachable from support stand 15, or may include a spiked tip for insertion into sand or ground.

Figure 2:
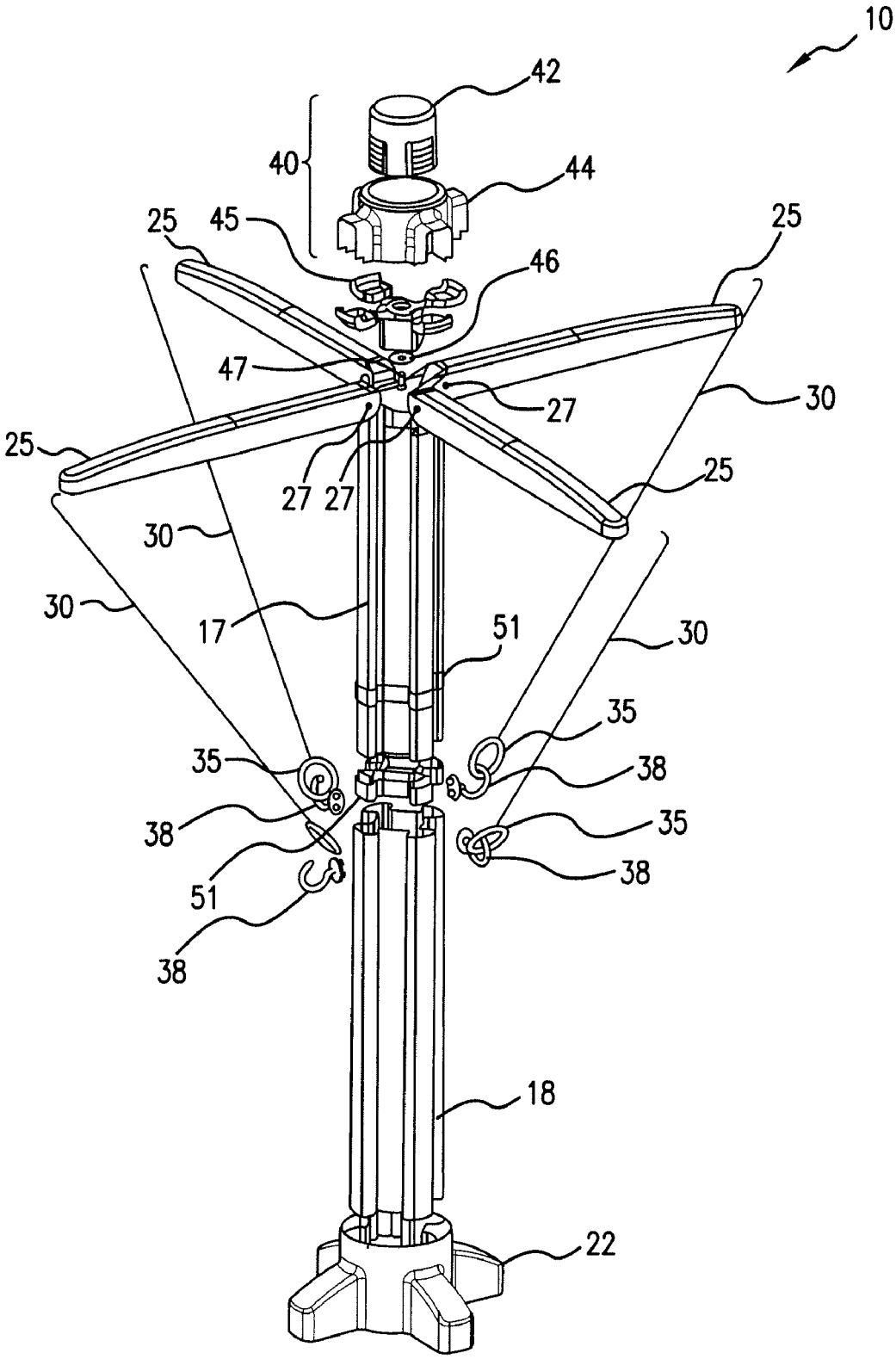
FIG. 2 is an exploded view of a ring toss game apparatus as in FIG. 1.
Figure 3:
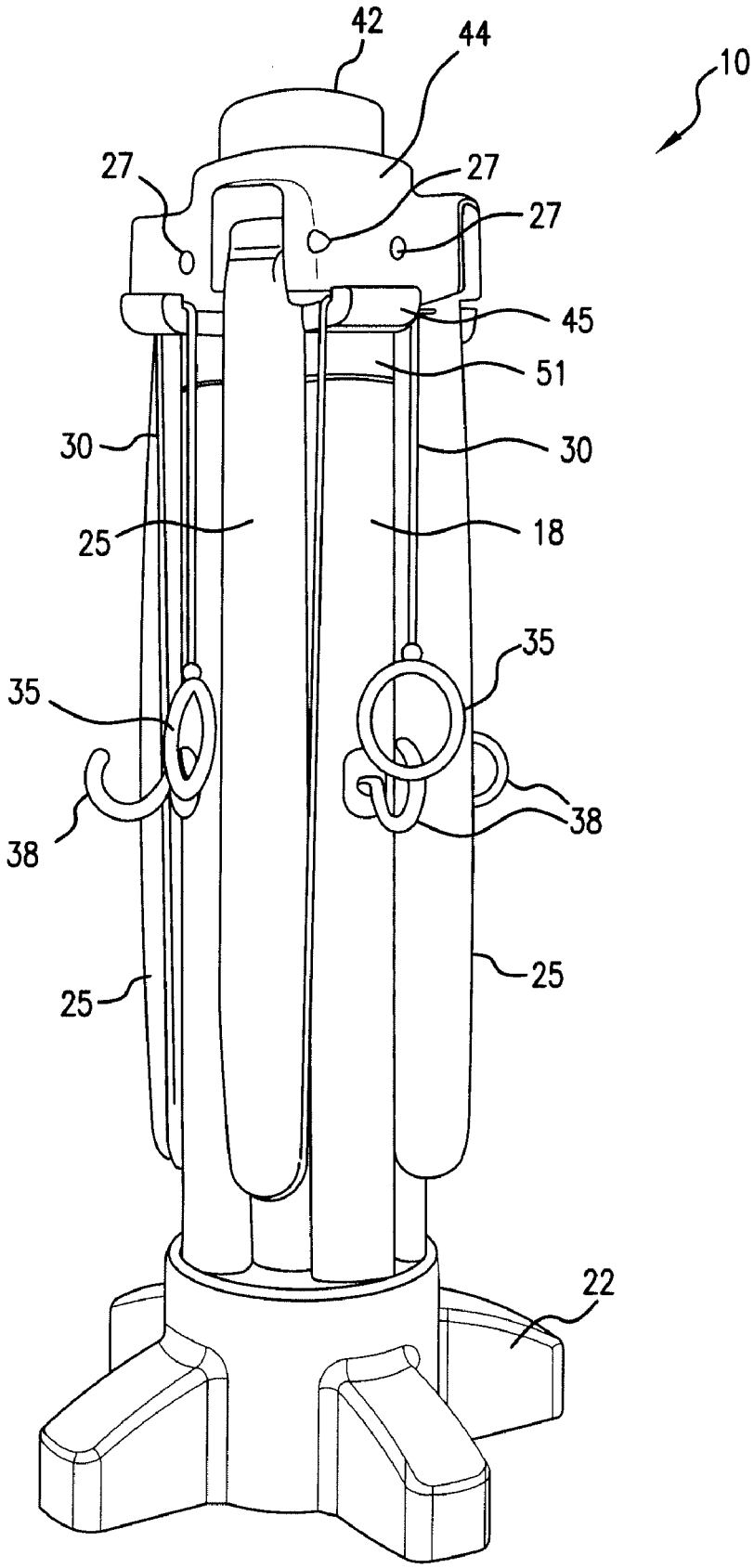
FIG. 3 is a perspective view of a ring toss game apparatus in the storing position.

FIGS. 1-4 also show arms 25 extending out away from support stand 15. Arms 25 are shown in FIG. 1 extending in a substantially perpendicular direction from support stand 15, but they could also extend at a slight angle up or down from perpendicular. In one implementation, arms 25 could extend upward or downward about 5 to 20 degrees from perpendicular and in another implementation, arms 25 could extend up to about 45 degrees upward or downward from perpendicular. Arms 25 are generally cantilevered to support stand 15 and are pivotably mounted at pivot points 27 which may be a pin, screw, or the like. Arms 25 pivot to storing position as shown in FIG. 3. Arms 25 may generally be formed of similar material to that of support stand 25. While the implementations shown in FIGS. 1-4 include four arms 25, the apparatus could be implemented with more or fewer arms, such as, for example, 2 or 3 arms, or up to 6 or 8 arms or more. In other implementations, arms 25 may be collapsible, such as by hinges or snap-locks; arms 25 may be extendable as by unfolding or telescoping; and arms 25 may be detachable from support stand 15.

Cords 30 are used to tether ring-like members 35 to the ends of arms 25 opposite pivot points 27. As used herein the term "cord" refers to a long flexible material such as a rope, string, chain, twisted twine, twisted mason line, fishing line or similar material having sufficient strength and tension to tether ring-like members 35 to arms 25. Cords 30 may also be formed of an elasticized cord, such as a bungee cord or the like. Ring-like members 35 are shown in FIGS. 1-4 as being circular or ring-shaped. As noted above, ring-like members 35 may be other shapes, such as square, triangular, or rectangular, so long as they have an opening in the center. Ring-like members 35 may be formed of metal, plastic, or similar material, but should have sufficient mass to be easily tossed and to keep cords 30 taut.

FIG. 1 shows ring-like members 35 around hooks 38. Hooks 38 are attached to support stand 15 at a distance corresponding to the length of cord 30, such that each ring-like member 35 can encircle a hook 38 while keeping cord 30 taut. Hooks 38 may be formed of metal, plastic, or similar material. In other implementations, hooks 38 may be corkscrews, nails with oversized heads, or have various shapes, such as a sine curve. As noted above, FIGS. 1-4 show 4 arms 25, and 4 corresponding ring-like members 35, cords 30, and hooks 38, but ring toss game apparatus 10 could be implemented with more or fewer than 4 arms. Arms 25, cords 30, and hooks 38 constitute the arm components of the apparatus. Regardless of the number implemented, each arm 25 includes a corresponding cord 30, ring-like member 35, and hook 38.

In an alternative implementation, hooks 38 are replaced with receptacles. The receptacles may include baskets, pockets, or the like. Ring-like members 35 are replaced with ball-like members. The term "ball-like member" is used herein to designate any weighted member that may be attached to cords 30 and fit within the receptacles. Ball-like members may include balls, but may also be a ring, or any other member that provides weight to the end of cord 30. In use, the ball-like member is tethered to arm 25. In the implementation described above, the user swings ring-like member 35 on cord 30 in an attempt to encircle hook 38. In this implementation, the user swings the ball-like member on cord 35 in an attempt to land within the receptacle.

FIG. 2 is an exploded view of ring toss game apparatus 10. In this implementation, one example of folding mechanism 40 for folding and locking ring toss game apparatus 10 is shown. Folding mechanism 40 includes push button 42 and top cap 44. Push button 42 fits within top cap 44 which is connected to arm support member 45 which is in turn connected to fastener 47. This mechanism is explained in greater detail below.

Figure 4:
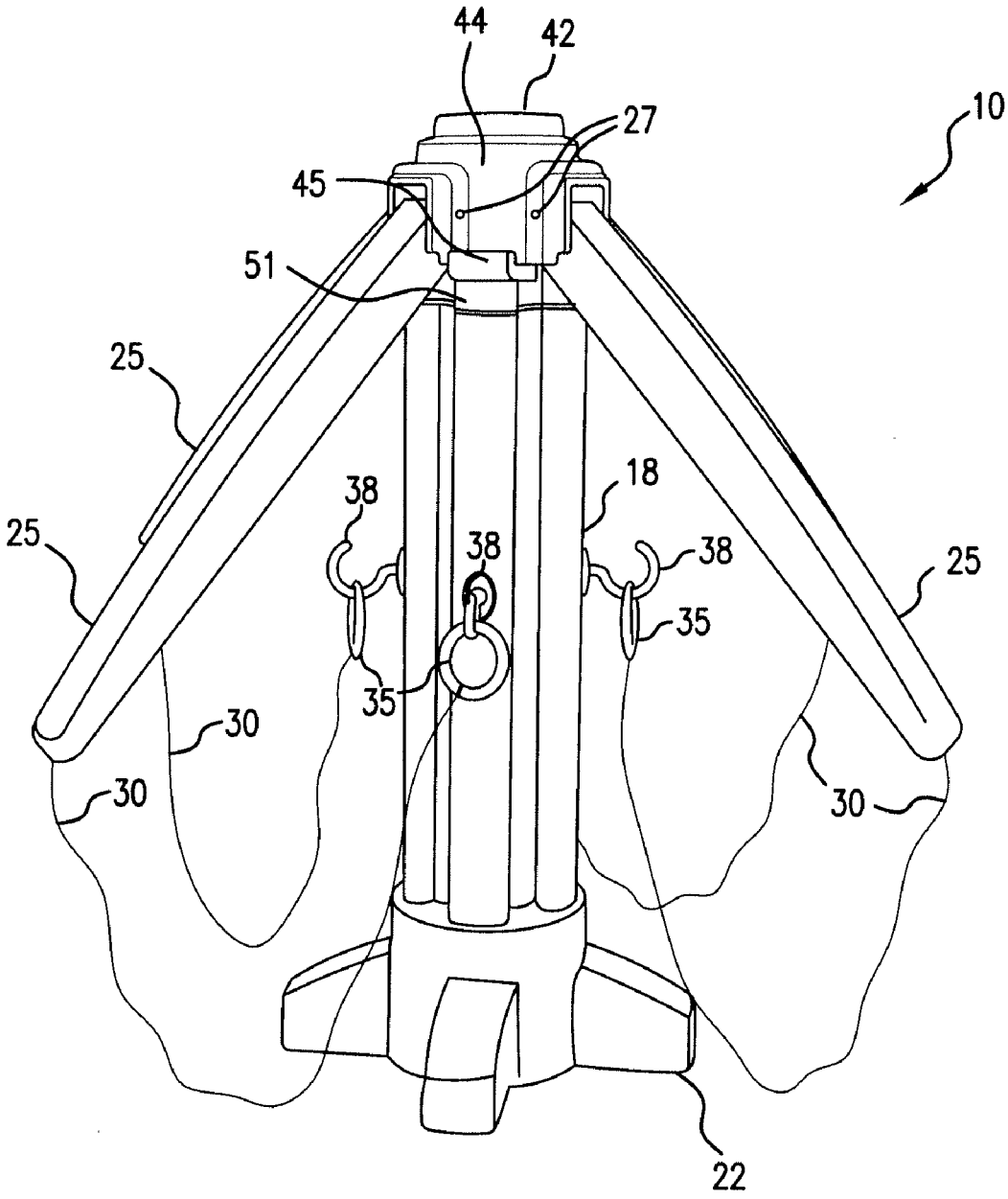
FIG. 4 is a perspective view of a ring toss game apparatus in an intermediate position between the position shown in FIG. 1 and the position shown in FIG. 3.

FIGS. 3-4 show the ring toss game apparatus 10 being folded or compacted for transport or storage. In FIGS. 3-4, the upper piece 17 (not shown) of support stand 15 has slid or telescoped inside of lower piece 18. FIG. 3 shows arms 25 in a position parallel to support stand 15 in the storing position. FIG. 4 shows ring toss game apparatus 10 in an intermediate position between the playing position shown in FIG. 1 and the storing position shown in FIG. 3. Folding mechanism 40 rotated permitting arms 25 to pivot and begin to swing down from the playing position to the storing position. To return ring toss game apparatus 10 to the playing position, push button 42 is depressed to raise arms 25, and folding mechanism 40 is rotated to permit arms 25 to be supported by support extensions 64 (shown in FIG. 8).

FIGS. 5-8 show different components of folding mechanism 40 that permit arms 25 to move between the playing position and the storing position. Each component works together and engages other components for proper operation. These figures demonstrate one possible implementation of a folding mechanism and should not be seen as limiting the overall concept of a ring toss game apparatus that may be folded and is easily portable and storable.

Figure 5:
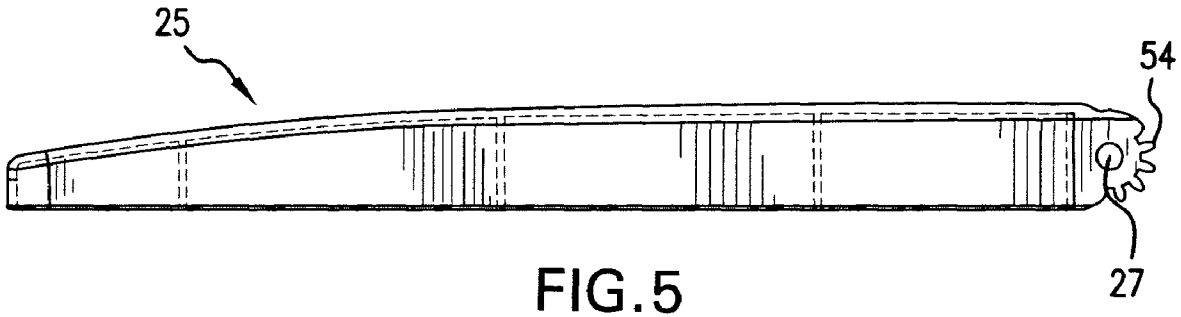
FIG. 5 is a side view of an arm as used in ring toss game apparatus as in FIGS. 1-4.
Figure 6:
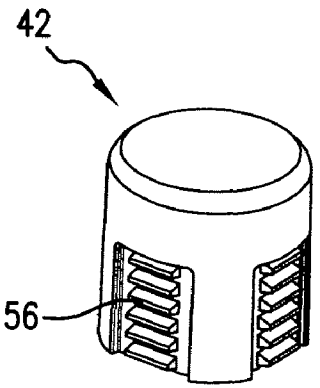
FIG. 6 is a perspective view of a push button as used in ring toss game apparatus as in FIGS. 1-4.

FIG. 5 shows arm 25 having a pivot point 27 where it can pivot between playing position and storing position. Arm 25 includes teeth 54 to form a gear that permits arm 25 to engage push button 42 shown in FIG. 6 and remain in or move to the desired position. FIG. 6 shows push button 42 having teeth 56 corresponding to teeth 54 of arm 25 to form the other part of the gear.

Figure 7:
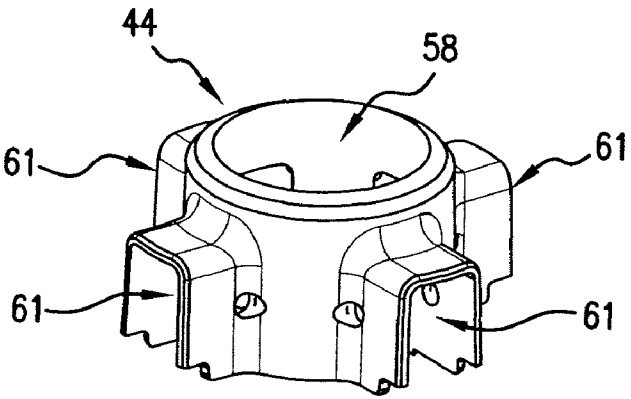
FIG. 7 is a perspective view of a top cap as used in ring toss game apparatus as in FIGS. 1-4.

FIG. 7 shows top cap 44 that includes opening 58 where push button 42 may slide upward and downward when depressed. Additional openings 61 correspond to each arm (shown in FIG. 5) and permit the arms to pivot between the playing position and the storing position.

Figure 8:
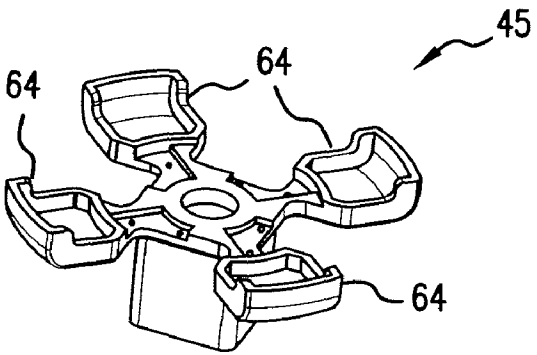
FIG. 8 is a perspective view of arm support apparatus as used in ring toss game apparatus as in FIGS. 1-4.

FIG. 8 shows arm support member 45 that includes arm support extensions 64 that are used to support arms 25 in place when in the playing position. In FIG. 1, support extensions 64 are supporting arms 25 in the playing position. Push button 42, top cap 44, and arms 25 can be rotated so that arms 25 are no longer supported by support extensions 64. At that point, arms 25 will pivot and move to the storing position by the effect of gravity. When push button 42 is depressed, arms 25 rise to extend out from support stand 15; folding mechanism can then be rotated back to the playing position. In this way, the user can bring the arms up from the storing position to the playing position or vice versa. Support extensions 64 of arm support member 45 are shown in FIGS. 3-4 after push button 42, top cap 44, and arms 25 have been rotated away from support extensions 64.

Thus, one possible folding mechanism has been described that can be used to move the apparatus from the playing position to the storing position. Other potential implementations of folding mechanisms may be used with the apparatus, as would be understood by those of skill in the art.

To convert from the playing position to the storing position, arms 25 are disengaged from arm support members 45; folding mechanism and arms 25 are rotated away from arm support members 45; and arms 25 are permitted to pivot down to be substantially parallel to support stand 15. To convert from the storing position to the playing position, push button 42 is depressed and arms 25 pivot up and away from support stand 15, and folding mechanism and arms 25 are rotated so that arms 25 are supported by arms support members 45.

All of the parts of the ring toss game apparatus may be formed of various solid materials, such as wood, aluminum, plastic, carbonite, polyvinyl chloride, steel, or other metals, metals alloys, or polymer-type materials.

It is to be understood that several variations in the apparatus may be necessary to implement a version of the ring toss game apparatus that is large enough for use on a floor or ground. For example, the support stand would need to be larger (and the other parts correspondingly larger). While the folding mechanism described herein may be used in such an implementation, other folding mechanisms may be more desirable in certain circumstances.

While the invention has been described in conjunction with specific exemplary implementations, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A game apparatus comprising:

a support stand;

two or more arms pivotably mounted to the support stand;

two or more ring-like members, each ring-like member tethered to one of the arms by a cord; and two or more hooks attached to the support stand, each hook corresponding to the tethered ring-like members and configured to receive the ring-like members when the ring-like members are swung on the cords.

2. The game apparatus of claim 1, wherein the arms are cantilevered to the support stand.

3. The game apparatus of claim 1, wherein the support stand includes two or more telescoping members.

4. The game apparatus of claim 1, comprising four cantilever arms, four ring-like members, and four hooks.

5. The game apparatus of claim 1, wherein the support stand is configured to be supported on a flat surface.

6. The game apparatus of claim 1, further comprising a base attached to the support stand that is configured to be supported on a table top or a floor or ground.

7. The game apparatus of claim 6, wherein the base includes a tripod.

8. The game apparatus of claim 6, wherein the base includes a spiked tip for insertion into sand or ground.

9. The game apparatus of claim 1, further comprising a folding mechanism attached to the support stand at an end near the arms.

10. A game apparatus comprising:

a support stand;

two or more arms pivotably mounted to the support stand;

two or more rings, each ring tethered to one of the two or more arms by a cord; and two or more hooks attached to the support stand, corresponding to the rings and configured to receive the rings when the rings are swung on the cord.

11. The game apparatus of claim 10, wherein the support stand comprises at least two telescopic members.

12. The game apparatus of claim 10, further comprising a folding mechanism attached to the support stand.

13. The game apparatus of claim 12, wherein the folding mechanism is movable between a playing position where the arms are pivotably mounted to the support stand and extend from the support stand in a substantially perpendicular direction from the support stand and a storing position where the arms are substantially parallel to the support stand.

14. The game apparatus of claim 13, further comprising an arm support member that includes a support for each arm and supports each arm when the folding mechanism is in the playing position.

15. The game apparatus of claim 10, further comprising a floatable base attached to the support stand that is configured to float on the surface of water.

16. A ring toss game apparatus comprising:

a stand that is movable between a playing position and a storing position, the stand including a first elongated member having an inner diameter and slidably engaging a second elongated member having an inner diameter, where the inner diameter of the first elongated member is smaller than the diameter of the second elongated member, such that when the stand is in the storing position, the first elongated member fits within the second elongated member;

at least two arm components pivotably mounted to the stand, and extending out from the stand in a substantially perpendicular direction from the stand when the stand is in the playing position, each arm component including:

a string extending from the arm; and a ring tethered to the string, the ring being of sufficient weight to keep the string taught during swinging; and at least two hooks, each hook corresponding to a single arm component and mounted to the stand for receiving the ring.

17. The ring toss game apparatus of claim 16, further comprising a folding mechanism mounted to the stand near the arm components.

18. The ring toss game apparatus of claim 16, further comprising an arm support member for supporting the arms in the substantially perpendicular direction to the stand when the stand is in the playing position.

19. The ring toss game apparatus of claim 18, wherein to convert the apparatus from the playing position to the storing position, the folding mechanism and arms are rotatable away from the arm support member to permit the arms to pivot toward the stand.

20. A game apparatus comprising:

a support stand;

two or more arms pivotably mounted to the support stand;

two or more ball-like members, each ball-like member tethered to one of the arms by a cord; and two or more receptacles attached to the support stand, each receptacle corresponding to the tethered ball-like members and configured to receive the ball-like members when the ball-like members are swung on the cords.

21. A method for converting the game apparatus of claim 17 from a playing position to a storing position, the method comprising:

rotating the folding mechanism and arms away from the arm support members; and permitting the arms to pivot from a playing position to a storing position.

22. The method of claim 21, wherein the arms extend away from a stand when in the playing position and the arms are substantially parallel to the stand when in the storing position.

23. The method of claim 22, where in the stand includes at least first and second telescoping members and the method further comprises:

sliding the first telescoping member into the second telescoping member.

* * * * *